US011548711B1

(12) United States Patent
Bhuyan et al.

(10) Patent No.: US 11,548,711 B1
(45) Date of Patent: Jan. 10, 2023

(54) PACKAGE FOR A COMPUTER PERIPHERAL DEVICE

(71) Applicant: Logitech Europe S.A., Lausanne (CH)

(72) Inventors: Sandipan Bhuyan, Hong Kong (HK); Wesley Wang, Shenzhen (CN); Andrew Chuang, Taiwan (TW); Adam Schettle, San Francisco, CA (US)

(73) Assignee: Logitech Europe S.A., Lausanne (CH)

( * ) Notice: Subject to any disclaimer, the term of this patent is extended or adjusted under 35 U.S.C. 154(b) by 0 days.

(21) Appl. No.: 17/495,540

(22) Filed: Oct. 6, 2021

(51) Int. Cl.

| | |
|---|---|
| ***B65D 73/00*** | (2006.01) |
| ***B65D 77/04*** | (2006.01) |
| ***B65D 81/05*** | (2006.01) |
| ***B65D 5/32*** | (2006.01) |
| ***B65D 5/38*** | (2006.01) |

(52) U.S. Cl.
CPC ..... *B65D 77/0433* (2013.01); *B65D 5/321* (2013.01); *B65D 5/38* (2013.01); *B65D 81/05* (2013.01)

(58) Field of Classification Search
CPC ..... B65D 5/321; B65D 5/38; B65D 77/0433; B65D 81/05; B65B 69/00
USPC ..... 206/1.5, 216, 320, 468, 576, 804; 53/492; 229/125.125
See application file for complete search history.

(56) References Cited

U.S. PATENT DOCUMENTS

| | | | | |
|---|---|---|---|---|
| 3,738,723 | A * | 6/1973 | Rudolph | B65D 11/12 206/45.24 |
| 3,828,923 | A * | 8/1974 | Phillips, Jr. | B65D 5/38 229/125 |
| 6,491,211 | B1 * | 12/2002 | Evans | B65D 77/02 206/532 |
| 6,676,013 | B2 * | 1/2004 | Auclair | B65D 5/54 229/122 |
| 8,011,512 | B2 * | 9/2011 | Brollier | B65D 83/0463 206/532 |
| 2003/0085262 | A1 * | 5/2003 | Evans | B65D 77/02 206/532 |
| 2015/0307246 | A1 * | 10/2015 | Patwardhan | B65D 77/0433 206/1.5 |

* cited by examiner

*Primary Examiner* — Luan K Bui
(74) *Attorney, Agent, or Firm* — Kilpatrick Townsend & Stockton LLP

(57) ABSTRACT

In some embodiments, a package for a computer peripheral device comprises an outer shell defining a first interior cavity and an open end. The package also comprises a peripheral tray comprising a rear side, a bottom side coupled to a bottom edge of the rear side, and a tongue. A first end of the tongue is coupled to the bottom side. The peripheral tray is positioned within the first interior cavity with a second end of the tongue coupled to the outer shell. An elongated portion of the tongue between the first end and the second end contacts the outer shell and is deflected toward the rear side. The peripheral tray is slidably translatable out of the first interior cavity through the open end so that a portion of the elongated portion moves away from the rear side and the bottom side rotates within the first interior cavity.

20 Claims, 6 Drawing Sheets

PACKAGE FOR A COMPUTER PERIPHERAL DEVICE

BACKGROUND

Computer peripheral devices often come in packaging that uses single-use plastics. These plastics may be a plastic shell that the computer peripheral device sits within for protection within an outer box before the packaging is opened, or the plastic may be a bag that the computer peripheral device sits within inside an outer box. However, the single-use plastics increase waste products that may have a negative impact on the environment. Improvements in computer peripheral device packaging are needed to provide packages with fewer single-use plastics.

BRIEF SUMMARY

In certain embodiments, a package for a computer peripheral device may comprise an outer box defining a first interior cavity and an open end; and a peripheral tray comprising a rear side, a bottom side coupled to a bottom edge of the rear side, a front side coupled to the bottom side, a left side coupled to a left longitudinal edge of the rear side, a right side coupled to a right longitudinal edge of the rear side, and a top side coupled to a top edge of the rear side, wherein the package is configured to transition from a stowed configuration wherein the rear side is positioned entirely within the first interior cavity of the outer box to an unstowed configuration wherein the rear side is at least partially positioned outside of the first interior cavity of the outer box, wherein in the stowed configuration the front side is positioned opposite the rear side, the left side is positioned opposite the right side, and the bottom side is positioned opposite the top side in order to define a second interior cavity configured to retain the computer peripheral device with the first interior cavity, and wherein transitioning from the stowed configuration to the unstowed configuration causes the bottom side to rotate from a stowed orientation substantially perpendicular to the rear side to an unstowed orientation substantially coplanar with the rear side, and causes a top portion of the rear side to be positioned outside of the first interior cavity so that the computer peripheral device is removable from the first interior cavity. In some embodiments, the peripheral tray may further comprise a tab coupled to the top side, wherein the tab is configured to be pulled by a user in order to transition the package from the stowed configuration to the unstowed configuration. The outer box may comprise a top flap configured to transition between a closed configuration wherein the top flap retains the peripheral tray within the first interior cavity and the package is in the stowed configuration, and an open configuration wherein the top flap does not cover the open end and the package is transitionable between the stowed configuration and the unstowed configuration. The tab may define an opening, wherein in the closed configuration, the tab extends through a slot in the top flap of the outer box so that a retail hook may extend through the opening so that the package hangs from the retail hook. Transitioning from the stowed configuration to the unstowed configuration can cause a radius of curvature of the front side to decrease so that the front side is bowed with a concave surface facing the top side. In some embodiments, the peripheral tray may further comprise a front top side coupled to the front side, a first flap portion coupled to front top side, and a second flap portion coupled to the first flap portion, wherein at least one of the first flap portion and the second flap portion are coupled to a third flap portion of the outer box. At least one of the first flap portion and the second flap portion may be removably coupled to the third flap portion of the outer box. In the stowed configuration and the unstowed configuration the second flap portion may be folded to overlap the first flap portion to define a channel, and wherein the third flap portion is positioned within the channel in order to be removably coupled to first flap portion and the second flap portion.

In some embodiments, a method for loading a computer peripheral device in a package may comprise: receiving the package in a stowed configuration, the package comprising an outer box defining a first interior cavity and an open end and a peripheral tray comprising a rear side, a bottom side coupled to a bottom edge of the rear side, a front side coupled to the bottom side, a left side coupled to a left longitudinal edge of the rear side, a right side coupled to a right longitudinal edge of the rear side, and a top side coupled to a top edge of the rear side; receiving an interaction with the peripheral tray; and transitioning the package from the stowed configuration wherein the rear side is positioned entirely within the first interior cavity of the outer box to an unstowed configuration wherein the rear side is at least partially positioned outside of the first interior cavity of the outer box, wherein in the stowed configuration the front side is positioned opposite the rear side, the left side is positioned opposite the right side, and the bottom side is positioned opposite the top side in order to define a second interior cavity configured to retain the computer peripheral device with the first interior cavity, and wherein transitioning from the stowed configuration to the unstowed configuration causes the bottom side to rotate from a stowed orientation substantially perpendicular to the rear side to an unstowed orientation substantially coplanar with the rear side, and causes a top portion of the rear side to be positioned outside of the first interior cavity so that the computer peripheral device is removable from the first interior cavity. The peripheral tray may further comprise a tab coupled to the top side, and the method may further comprise receiving the interaction as a pull at the tab by a user in order to transition the package from the stowed configuration to the unstowed configuration. The outer box may comprise a top flap configured to transition between a closed configuration wherein the top flap retains the peripheral tray within the first interior cavity and the package is in the stowed configuration, and an open configuration wherein the top flap does not cover the open end and the package is transitionable between the stowed configuration and the unstowed configuration. The tab may define an opening, wherein in the closed configuration, the tab extends through a slot in the top flap of the outer box so that a retail hook may extend through the opening so that the package hangs from the retail hook. Transitioning from the stowed configuration to the unstowed configuration can cause a radius of curvature of the front side to decrease so that the front side is bowed with a concave surface facing the top side. In some embodiments, the peripheral tray may further comprise a front top side coupled to the front side, a first flap portion coupled to front top side, and a second flap portion coupled to the first flap portion, wherein at least one of the first flap portion and the second flap portion are coupled to a third flap portion of the outer box. At least one of the first flap portion and the second flap portion may be removably coupled to the third flap portion of the outer box. In the stowed configuration and the unstowed configuration the second flap portion may be folded to overlap the first flap portion to define a channel, and wherein the third flap portion is positioned within the channel in order to be removably coupled to first flap portion and the second flap portion.

In some embodiments, a package for a computer peripheral device may comprise an outer shell defining a first interior cavity and an open end. The package may further include a peripheral tray comprising a rear side, a bottom side coupled to a bottom edge of the rear side, and a tongue, wherein a first end of the tongue is coupled to the bottom side. The peripheral tray may be positioned within the first interior cavity of the outer shell with a second end of the tongue coupled to the outer shell and so that an elongated portion of the tongue between the first end and the second end contacts the outer shell and is deflected toward the rear side of the peripheral tray. The peripheral tray may be configured to be slidably translated out of the first interior cavity through the open end so that a portion of the elongated portion of the tongue moves away from the rear side of the peripheral tray and the bottom side of the peripheral tray rotates within the first interior cavity.

This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim.

The foregoing, together with other features and examples, will be described in more detail below in the following specification, claims, and accompanying drawings.

BRIEF DESCRIPTION OF THE DRAWINGS

The features of the various embodiments described above, as well as other features and advantages of certain embodiments of the present invention will be more apparent from the following detailed description taken in conjunction with the accompanying drawings, in which.

DETAILED DESCRIPTION

Figure 1A:
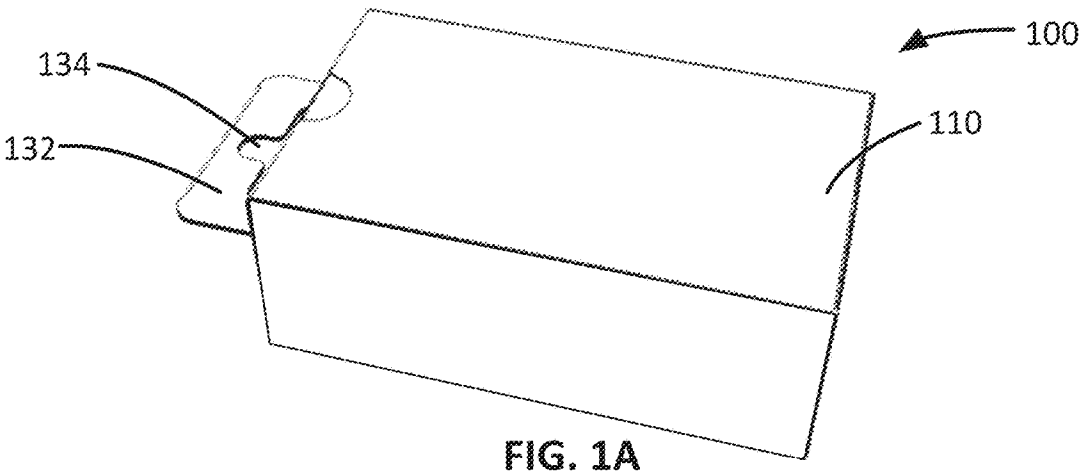
FIG. 1A shows an example of a package for a computer peripheral device in a stowed configuration, according to certain embodiments.

Aspects of the present disclosure relate generally to computer peripheral devices, and more particularly to packaging for computer peripheral devices, according to certain embodiments.

In the following description, various examples of the package are described. For purposes of explanation, specific configurations and details are set forth in order to provide a thorough understanding of the embodiments. However, it will be apparent to one skilled in the art that certain embodiments may be practiced or implemented without every detail disclosed. Furthermore, well-known features may be omitted or simplified in order to prevent any obfuscation of the novel features described herein.

The following high level summary is intended to provide a basic understanding of some of the novel innovations depicted in the figures and presented in the corresponding descriptions provided below. Many of the embodiments relate to novel packages for computer peripheral devices. The package can include an outer box with an interior cavity and a peripheral tray that can be positioned within the interior cavity. The peripheral tray can transition from a stowed configuration with the computer peripheral device positioned entirely within the outer box to an unstowed configuration with the computer peripheral device at least partially positioned outside of the interior cavity of the outer box so that the computer peripheral device is removable from the package. Computer mice, keyboards, or other devices can be referred to generally as "computer peripheral devices" throughout this disclosure.

In some embodiments, the concepts described above can be implemented, for instance, by a package comprising an outer shell or box defining a first interior cavity and an open end and a peripheral tray. The peripheral tray can include a rear side, a bottom side coupled to a bottom edge of the rear side, a front side coupled to the bottom side, a left side coupled to a left longitudinal edge of the rear side, a right side coupled to a right longitudinal edge of the rear side, and a top side coupled to a top edge of the rear side. The package can transition from a stowed configuration with the rear side positioned entirely within the first interior cavity of the outer box to an unstowed configuration with the rear side at least partially positioned outside of the first interior cavity of the outer box. In the stowed configuration, the front side is positioned opposite the rear side, the left side is positioned opposite the right side, and the bottom side is positioned opposite the top side in order to define a second interior cavity configured to retain the computer peripheral device with the first interior cavity. Transitioning from the stowed configuration to the unstowed configuration can cause the bottom side to rotate from a stowed orientation substantially perpendicular to the rear side to an unstowed orientation substantially coplanar with the rear side. Transitioning to the unstowed configuration can also cause a top portion of the rear side to be positioned outside of the first interior cavity so that the computer peripheral device is removable from the first interior cavity.

It is to be understood that this high level summary is presented to provide the reader with a baseline understanding of some of the novel aspects of the present disclosure and a roadmap to the details that follow. This high level summary in no way limits the scope of the various embodiments described throughout the detailed description and each of the figures referenced above are further described below in greater detail and in their proper scope.

Embodiments of a Package for a Computer Peripheral Device

Figure 2A:
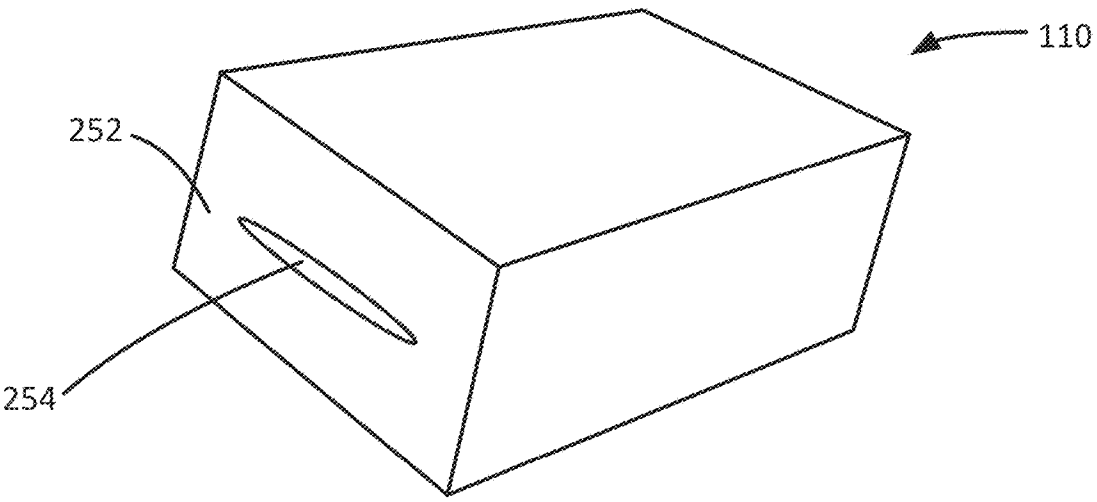
FIG. 2A shows an example of an outer box of a package in a closed configuration, according to certain embodiments.
Figure 2B:
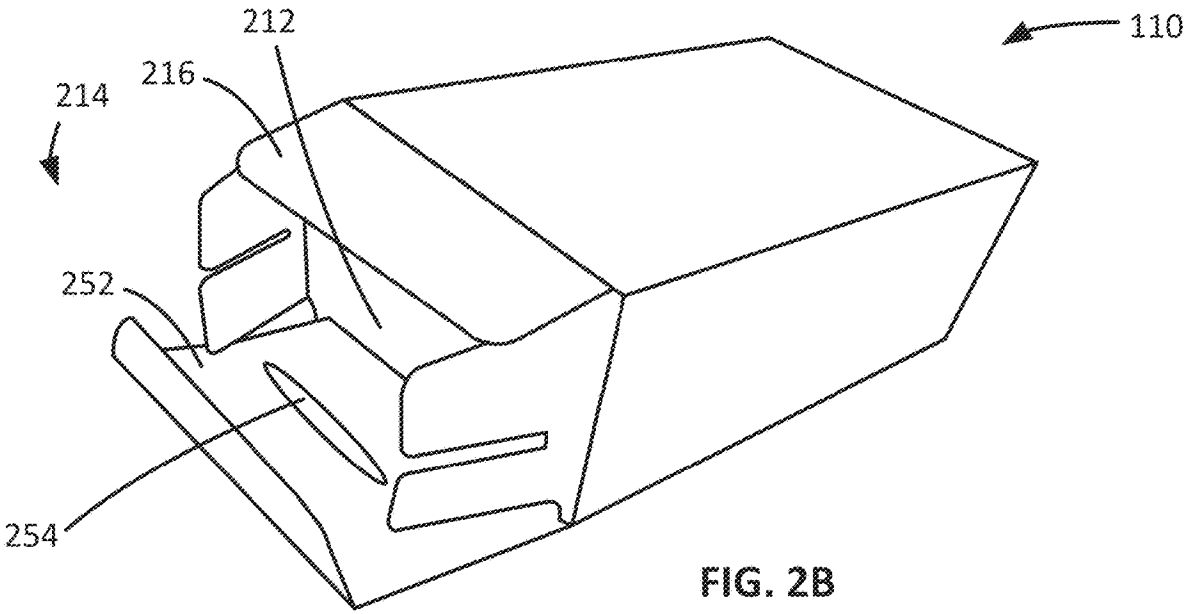
FIG. 2B shows an example of an outer box of a package in an open configuration, according to certain embodiments.

FIG. 1A shows an example of a package 100 for a computer peripheral device in a stowed configuration, according to certain embodiments. In the stowed configuration, the computer peripheral device can be positioned entirely within an outer box 110 of the package 100. The outer box 110, which is illustrated in FIGS. 2A-2B, can be a generally rectangular prism box with six sides. At least one of the sides can be openable for loading or unloading an item into an interior cavity of the outer box 110. The size of the outer box 110 can be based on the computer peripheral device that is to be stored in the package 100. For example, if the package 100 stores a computer mouse, the outer box 110 may have dimensions larger than the computer mouse, such as 65×40×109 mm.

As shown in FIGS. 2A-2B, the outer box 110 can include a top flap 252 coupled to a bottom of the outer box 110. The top flap 252 can be rectangular with a same width as a width of the bottom of the outer box 110 and longer than a height of the outer box 110, such that the top flap 252 can fold over the open end 214 of the outer box 110. The top flap 252 may include a fold that can tuck into the outer box 110 when folded over the open end 214. The top flap 252 can transition from a closed configuration to an open configuration. The closed configuration, as illustrated in FIG. 2A, may correspond to the stowed configuration, where the top flap 252 can retain the peripheral tray within the first interior cavity 212. Additionally, in the closed configuration, a tab 132 of the peripheral tray can extend through a slot 254 in the top flap 252 so that a retail hook can extend through an opening 134 of the tab 132. The tab 132 may be rectangular and can have a width that is the same or less than the width of a top side of the peripheral tray. The opening 134 may be ovoid, circular, a combination thereof, or any other suitable shape. In the open configuration, as illustrated in FIG. 2B, the top flap 252 may not cover the open end 214, such that the package 100 can transition from the stowed configuration to the unstowed configuration.

Additionally, the outer box 110 can include a third flap portion 216. The third flap portion 216 can be generally rectangular and can be coupled to an opposite side of the outer box 110 than the top flap 252. The third flap portion 216 may have a width equal to the top flap 252, and a height of the third flap portion 216 can be smaller than a height of the outer box 110.

The computer peripheral device can be positioned within a peripheral tray inside the outer box 110. The peripheral tray, as shown as peripheral tray 120 in FIG. 1B and FIGS. 3A-3B, can also be a generally rectangular prism box with at least one openable side. The peripheral tray can have dimensions that are smaller than the outer box 110, but larger than the computer peripheral device. The peripheral tray can include a front side (e.g., front side 244 in FIGS. 3-6) that is translatably slidable towards a bottom side (e.g., bottom side 124 in FIG. 1B). The peripheral tray can include the tab 132 coupled to a top side (e.g., top side 126 in FIGS. 3A-3B). The tab 132 can be used to transition the package to an unstowed configuration where the computer peripheral device is at least partially outside of the outer box 110 and removable from the package 100. A retail hook can be inserted through the opening 134 to hang the package 100 from the retail hook.

The outer box 110 and the peripheral tray may both be made out of paper products, such as a matte polypropylene paper. Additionally the outer box 110 and/or the peripheral tray may have a ultraviolet (UV) coating. Using paper products can reduce use of single-use plastics for the package 100 of the computer peripheral device.

Figure 1B:
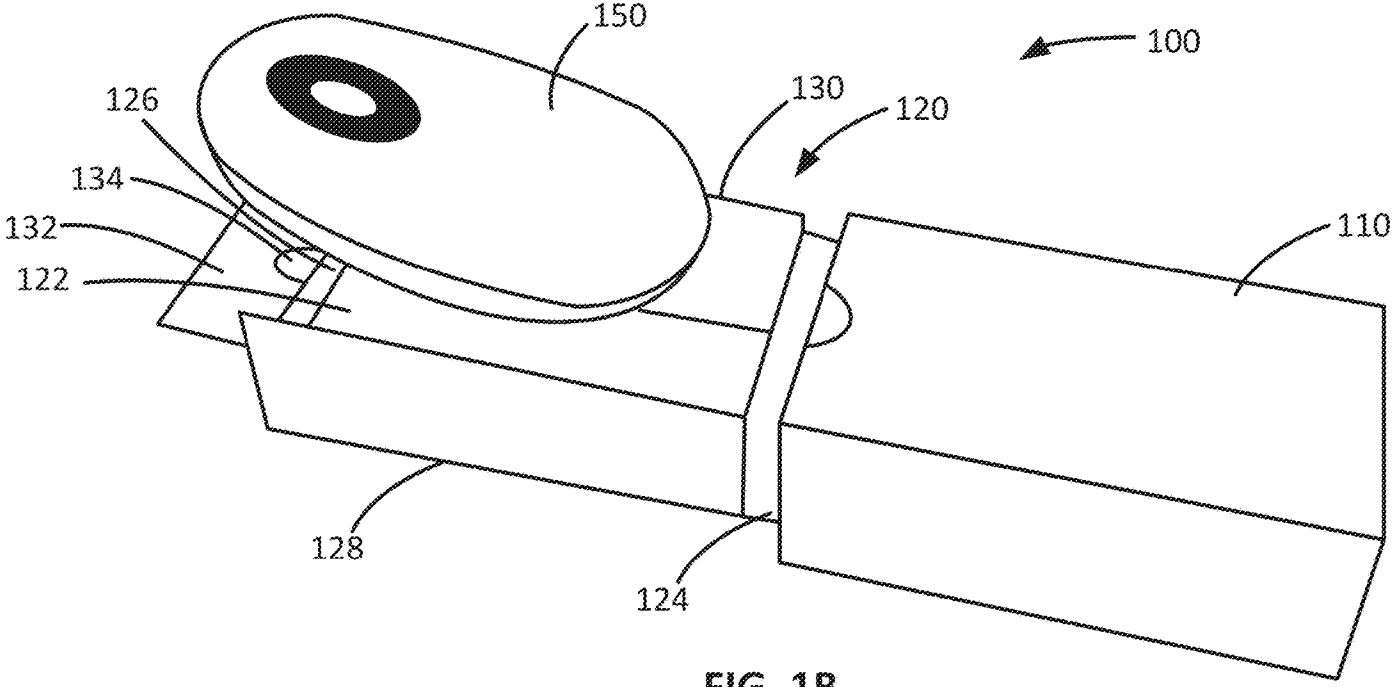
FIG. 1B shows an example of a package for a computer peripheral device in an unstowed configuration, according to certain embodiments.

FIG. 1B shows an example of the package 100 in FIG. 1A in an unstowed configuration, according to certain embodiments. A peripheral tray 120 extends outside of the outer box 110 through an open end of the outer box 110 in the unstowed configuration. The peripheral tray 120 can be positioned within a first inner cavity of the outer box 110 and can define a second inner cavity (e.g., second inner cavity 242 in FIGS. 3A-3B) that a computer peripheral device 150 can be positioned within. As described previously, the peripheral tray 120 can be a generally rectangular prism box with dimensions larger than the computer peripheral device 150, but smaller than the outer box 110.

Figure 3A:
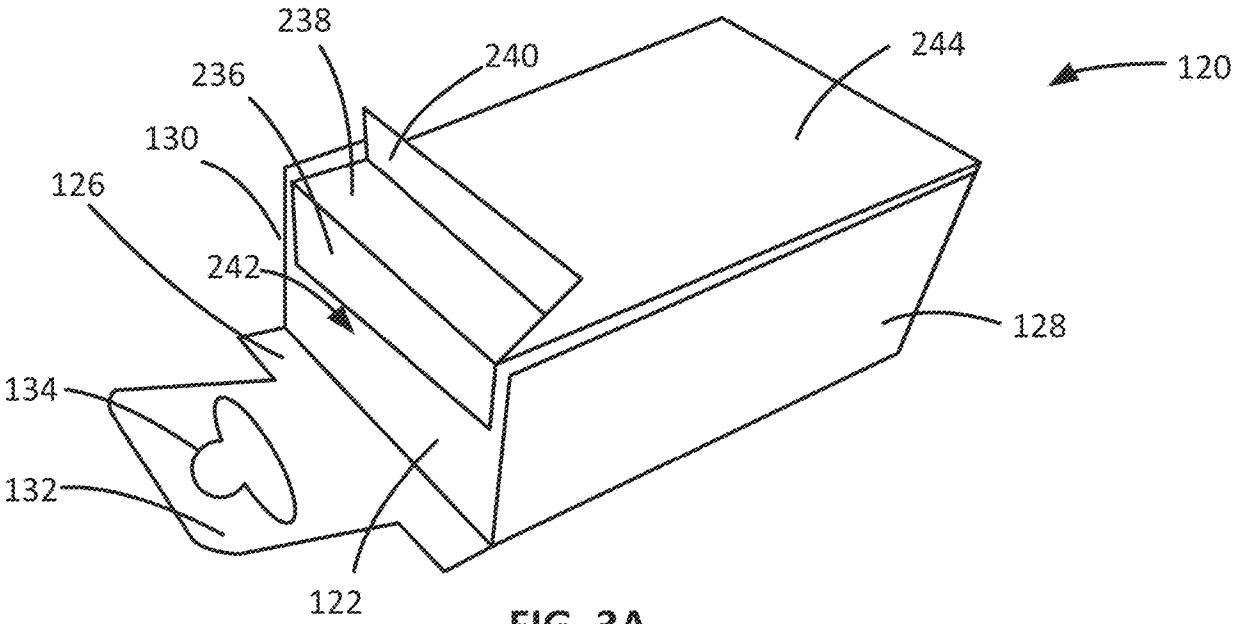
FIG. 3A shows an example of a peripheral tray of a package in a stowed configuration, according to certain embodiments.
Figure 3B:
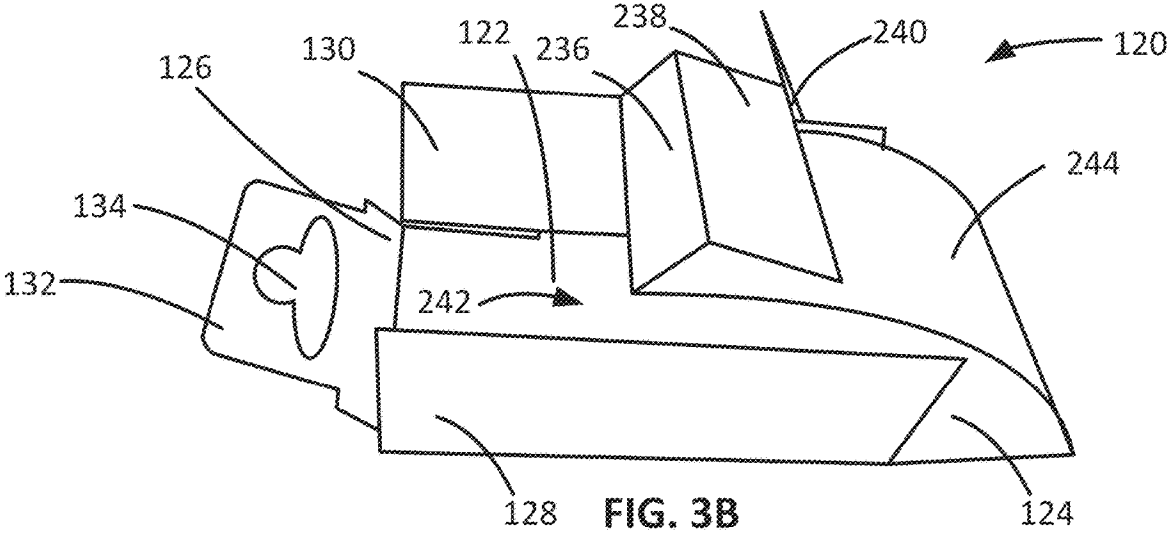
FIG. 3B shows an example of a peripheral tray of a package in an unstowed configuration, according to certain embodiments.

Referring to FIGS. 3A-3B, which show the peripheral tray 120, the peripheral tray 120 includes a rear side 122, a bottom side 124 coupled to a bottom edge of the rear side 122, a front side 244 coupled to the bottom side 124, a left side 128 coupled to a left longitudinal edge of the rear side 122, a right side 130 coupled to a right longitudinal edge of the rear side 122, and a top side 126 coupled to a top edge of the rear side 122. The front side 244 and the rear side 122 of the peripheral tray 120 can be substantially similar in size, and the right side 130 and the left side 128 can be substantially similar in size. In the unstowed configuration, as shown in FIG. 3B, the bottom side 124 can be substantially coplanar with the rear side 122. Additionally, in the unstowed configuration, a top portion of the rear side 122 is positioned outside of the first inner cavity of the outer box 110 so that the computer peripheral device 150 is removable from the outer box 110. A tab 132 coupled to the top side 126 can be pulled by a user to transition the package to the unstowed configuration.

The peripheral tray 120 can also include folds extending from the front side 244. The folds can be rectangular and generally equal in size. For example, the folds may be a front top side 236 coupled to the front side 244, a first flap portion 238 coupled to the front top side 236, and a second flap portion 240 coupled to the first flap portion 238.

Figure 4:
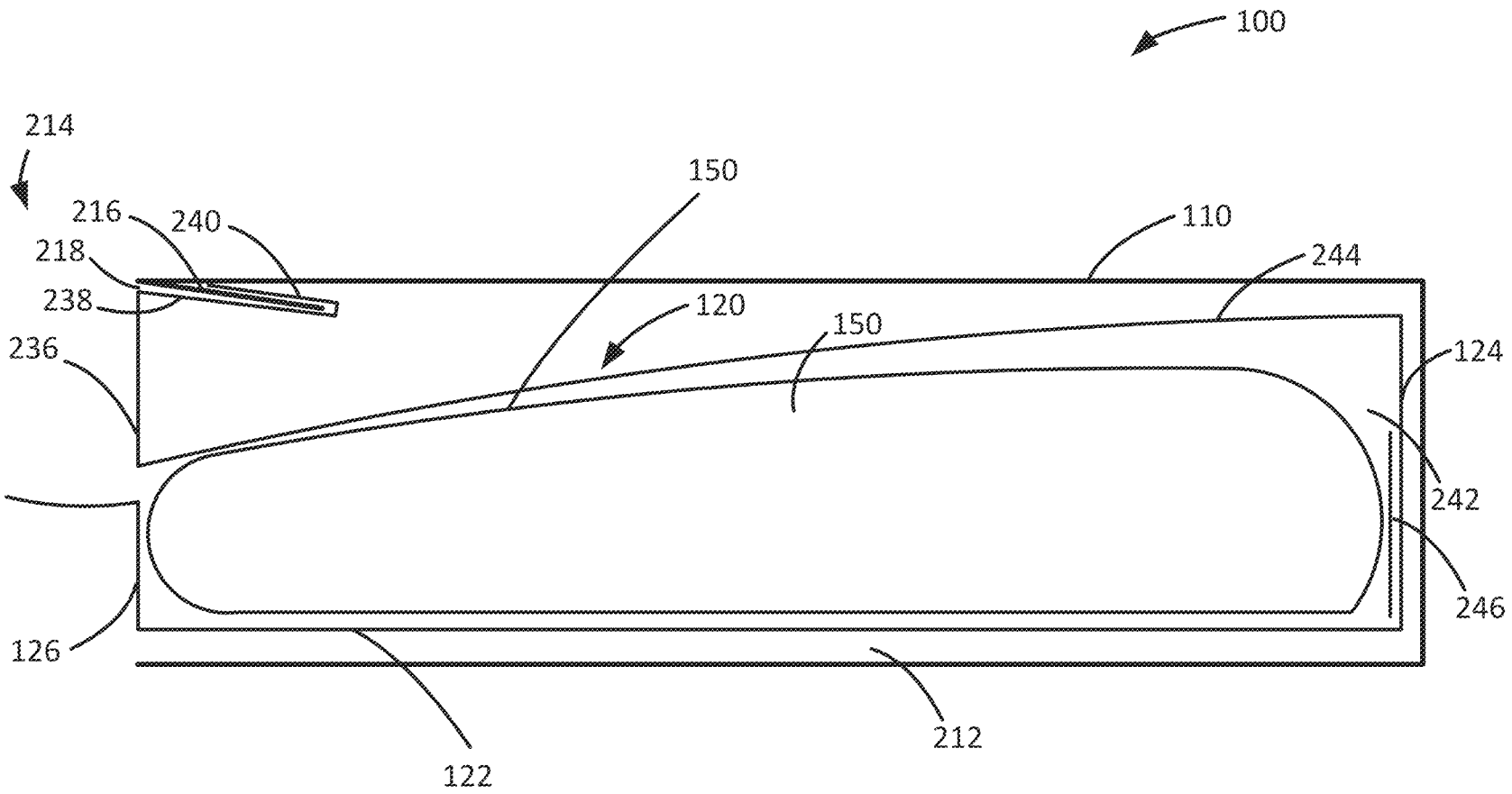
FIG. 4 shows an example of a cross-section view of a package for a computer peripheral device in a stowed configuration, according to certain embodiments.

FIG. 4 shows an example of a cross-section view of a package 100 for a computer peripheral device 150 in a stowed configuration, according to certain embodiments. The package 100 includes an outer shell, such as an outer box 110, and a peripheral tray 120. The outer box 110 defines a first interior cavity 212 and an open end 214. The peripheral tray 120 is positioned within the first interior cavity 212.

The peripheral tray 120 includes a rear side 122, a bottom side 124 coupled to a bottom edge of the rear side 122, a front side 244 coupled to the bottom side 124, a left side coupled to a left longitudinal edge of the rear side 122, a right side coupled to a right longitudinal edge of the rear side 122, and a top side 126 coupled to a top edge of the rear side 122. The peripheral tray 120 may additionally include a second bottom side 246 that is coupled to the right side and the left side, but not directly coupled to the rear side 122 nor to the front side 244. The second bottom side 246 may have a height less than a height of the right side and the left side. The second bottom side 246 may prevent the computer peripheral device 150 from moving within the peripheral tray 120 while the package 100 is transitioned from the stowed configuration to the unstowed configuration. In the stowed configuration, the front side 244 can be positioned opposite the rear side 122, the left side can be positioned opposite the right side, and the bottom side 124 can be positioned opposite the top side 126 to define the second interior cavity 242, which can retain the computer peripheral device 150 with the first interior cavity 212. The left side and the right side can provide rigidity to the outer box 110, such that the computer peripheral device 150 is protected within the package 100. Additionally, in the stowed configuration, the rear side 122 can be positioned entirely within the first interior cavity 212 of the outer box 110.

At least one of a first flap portion 238 or a second flap portion 240 of the peripheral tray 120 may be coupled to a third flap portion 216 of the outer box 110. In some examples, the third flap portion 216 may be permanently coupled to the at least one of the first flap portion 238 and the second flap portion 240. The permanent coupling may involve an adhesive, such as glue, fixing the third flap portion 216 to the first flap portion 238 and/or the second flap portion 240. Alternatively, at least of the first flap portion 238 and the second flap portion 240 may be removably coupled to the third flap portion 216. In such examples, the second flap portion 240 can be folded to overlap the first flap portion 238 and define a channel 218. The third flap portion 216 can be positioned within the channel 218 to be removably coupled to the first flap portion 238 and the second flap portion 240.

Figure 5:
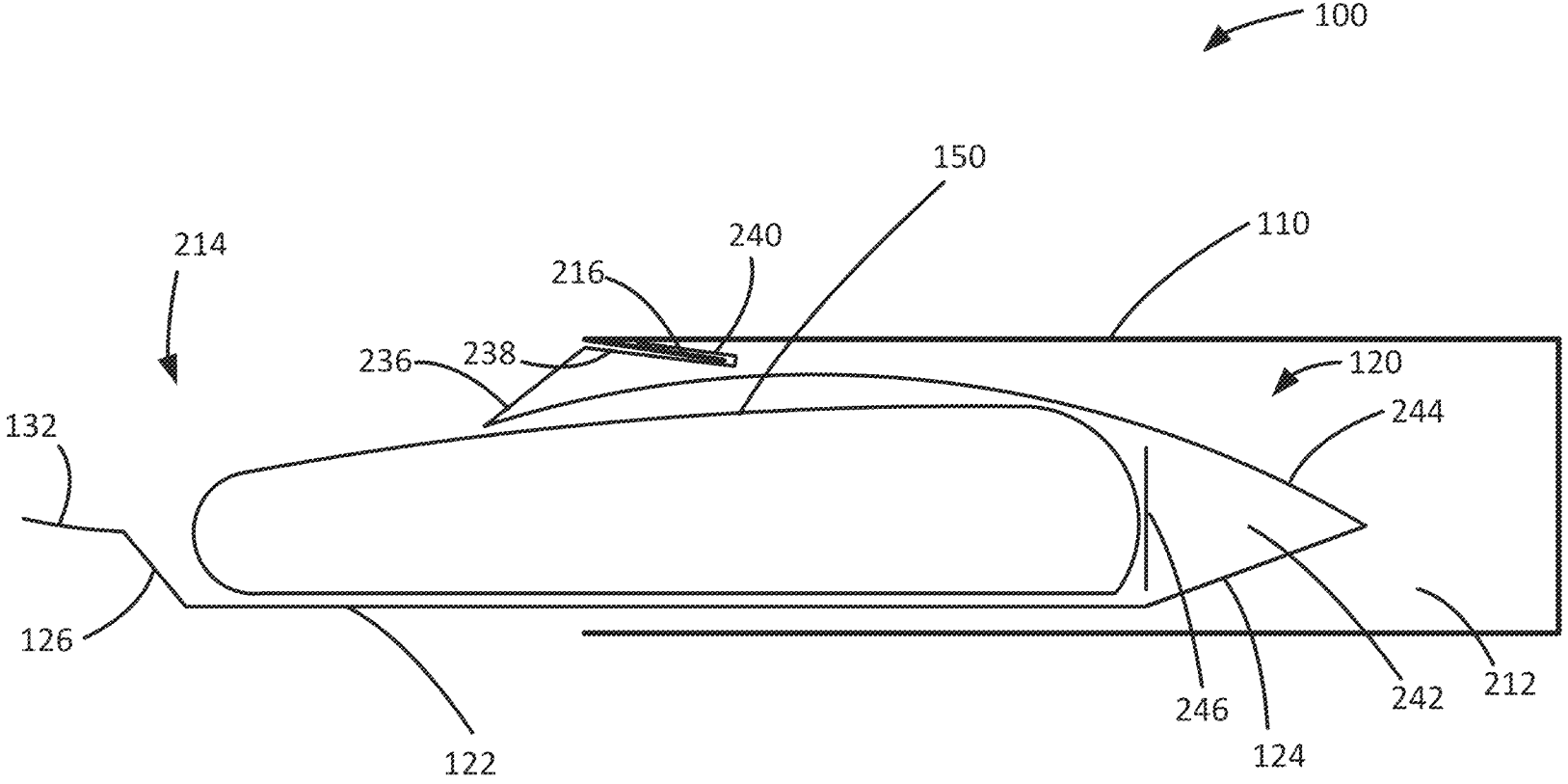
FIG. 5 shows an example of a cross-section view of a package for a computer peripheral device transitioning from a stowed configuration to an unstowed configuration, according to certain embodiments.
Figure 6:
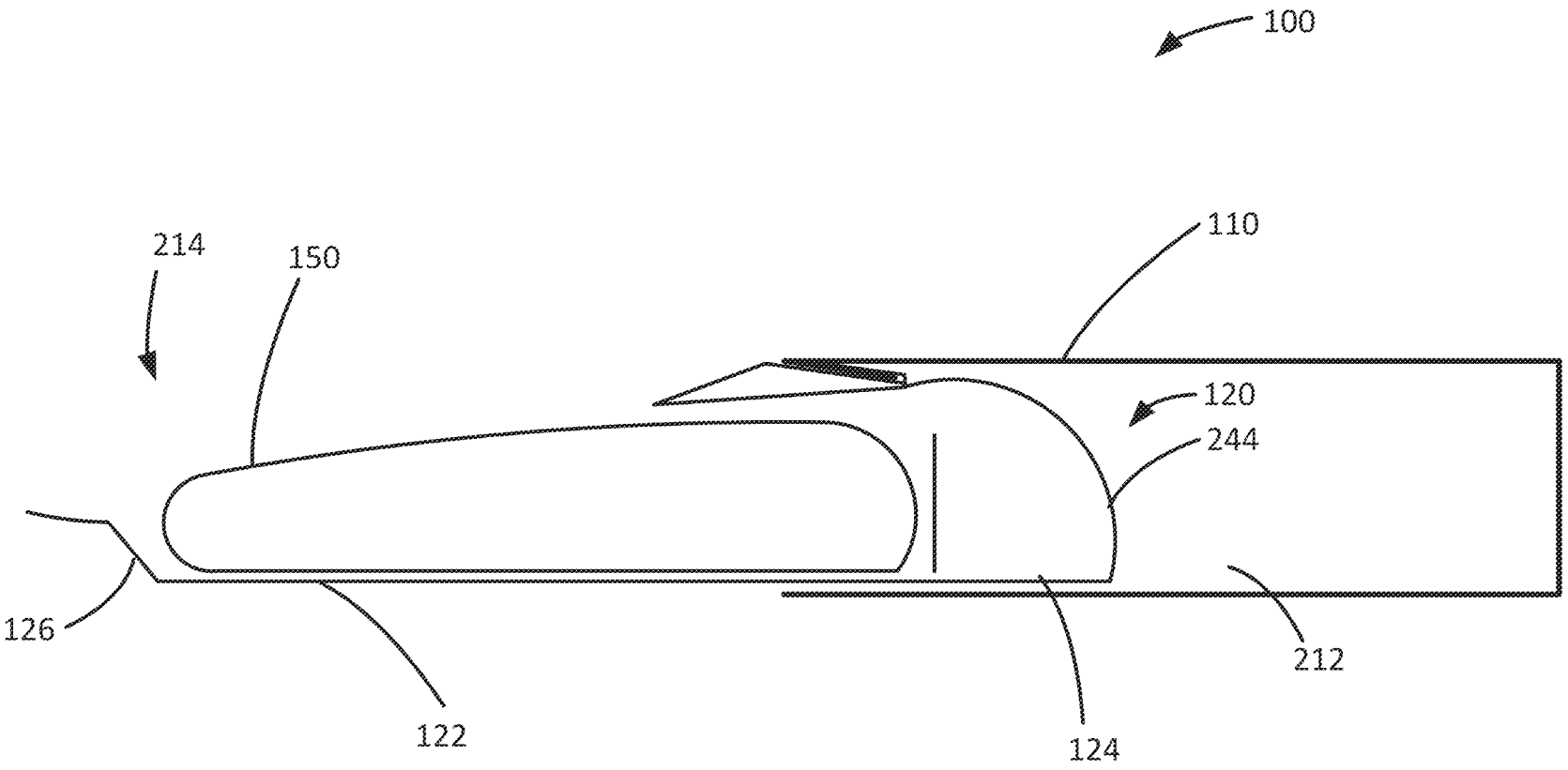
FIG. 6 shows an example of a cross-section view of a package for a computer peripheral device in an unstowed configuration, according to certain embodiments.

FIG. 5 shows an example of a cross-section view of a package 100 for a computer peripheral device 150 transitioning from a stowed configuration to an unstowed configuration, according to certain embodiments. As previously described, the package 100 includes an outer box 110 and a peripheral tray 120 that the computer peripheral device 150 is positioned within. During the transitioning from the stowed configuration to the unstowed configuration, such as when a tab 132 of a top side 126 of the peripheral tray 120 is pulled, a bottom side 124 of the peripheral tray 120 can rotate from a stowed orientation to an unstowed orientation. In the stowed orientation, the bottom side 124 is substantially perpendicular to a rear side 122 (as shown in FIG. 4), whereas in the unstowed orientation, the bottom side 124 is substantially coplanar with the rear side (as shown in FIG. 6). A second bottom side 246 of the peripheral tray 120 can remain substantially perpendicular to the rear side 122 during the transitioning, so that the computer peripheral device 150 is retained within a second interior cavity defined by the peripheral tray 120.

The peripheral tray 120 also includes a tongue. A first end of the tongue, which can be considered a front side 244 of the peripheral device, can be coupled to the bottom side 124 of the peripheral device. The tongue can also include a second end, which may correspond to a second flap portion 240 of the peripheral tray. Additionally, the tongue can include an elongated portion, which can correspond to the front top side 236 and a first flap portion 238 of the peripheral tray 120. The elongated portion can contact the outer box 110, such as a third flap portion 216 of the outer box 110, which can deflect the elongated portion toward the rear side 122 of the peripheral tray 120.

Transitioning from the stowed configuration to the unstowed configuration can cause a radius of curvature of the front side 244 to decrease so that the front side 244 is bowed with a concave surface facing the top side 126. Additionally, during the transitioning from the stowed configuration to the unstowed configuration, the peripheral tray 120 can slidably translate out of a first interior cavity 212 of the outer box 110 through an open end 214 of the outer box 110. A portion of the elongated portion of the tongue can move away from the rear side 122 of the peripheral tray 120, such that the tongue does not contact the computer peripheral device 150 as the package 100 transitions from the stowed configuration to the unstowed configuration. As a result, the computer peripheral device 150 may be removed from the package 100 without any scratches or other defects caused by the peripheral tray 120. Slidably translating the peripheral tray 120 out of the first interior cavity 212 can also result in the bottom side 124 rotating within the first interior cavity 212 and a top portion of the rear side 122 being positioned outside of the first interior cavity 212 so that the computer peripheral device 150 can be removed from the first interior cavity 212. But, the contact of the elongated portion of the tongue with the outer box 110 can restrict the removal of the first end of the tongue from the outer box 110.

FIG. 6 shows an example of a cross-section view of a package 100 for a computer peripheral device 150 in an unstowed configuration, according to certain embodiments. The package 100 includes an outer box 110 and a peripheral tray 120 that the computer peripheral device 150 is positioned within. In the unstowed configuration, a rear side of 122 of the peripheral tray 120 is at least partially positioned outside of a first interior cavity 212 of the outer box 110. A bottom side 124 of the peripheral tray 120 is substantially coplanar with the rear side 122 in the unstowed configuration. Additionally, a front side 244 of the peripheral tray 120 has a decreased radius of curvature in the unstowed configuration compared to a stowed configuration. As illustrated, the front side 244 is bowed with a concave surface facing a top side 126 of the peripheral tray 120. In the unstowed configuration, the computer peripheral device 150 is removable from the first interior cavity 212 at an open end of the outer box 110.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter. The various embodiments illustrated and described are provided merely as examples to illustrate various features of the claims. However, features shown and described with respect to any given embodiment are not necessarily limited to the associated embodiment and may be used or combined with other embodiments that are shown and described. Further, the claims are not intended to be limited by any one example embodiment.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations, and/or additions to the present subject matter as would be readily apparent to one of ordinary skill in the art. Indeed, the methods and systems described herein may be embodied in a variety of other forms; furthermore, various omissions, substitutions and changes in the form of the methods and systems described herein may be made without departing from the spirit of the present disclosure. The accompanying claims and their equivalents are intended to cover such forms or modifications as would fall within the scope and spirit of the present disclosure.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, or other action "based on" one or more recited conditions or values may, in practice, be based on additional conditions or values beyond those recited.

What is claimed is:

1. A package for a computer peripheral device, the package comprising:

an outer box defining a first interior cavity and an open end; and a peripheral tray comprising a rear side, a bottom side coupled to a bottom edge of the rear side, a front side coupled to the bottom side, a left side coupled to a left longitudinal edge of the rear side, a right side coupled to a right longitudinal edge of the rear side, and a top side coupled to a top edge of the rear side, wherein the package is configured to transition from a stowed configuration wherein the rear side is positioned entirely within the first interior cavity of the outer box to an unstowed configuration wherein the rear side is at least partially positioned outside of the first interior cavity of the outer box, wherein in the stowed configuration the front side is positioned opposite the rear side, the left side is positioned opposite the right side, and the bottom side is positioned opposite the top side in order to define a second interior cavity configured to retain the computer peripheral device with the first interior cavity, and wherein transitioning from the stowed configuration to the unstowed configuration causes the bottom side to rotate from a stowed orientation substantially perpendicular to the rear side to an unstowed orientation substantially coplanar with the rear side, and causes a top portion of the rear side to be positioned outside of the first interior cavity so that the computer peripheral device is removable from the first interior cavity.

2. The package of claim 1, wherein the peripheral tray further comprises a tab coupled to the top side, wherein the tab is configured to be pulled by a user in order to transition the package from the stowed configuration to the unstowed configuration.

3. The package of claim 2, wherein the outer box comprises a top flap configured to transition between a closed configuration wherein the top flap retains the peripheral tray within the first interior cavity and the package is in the stowed configuration, and an open configuration wherein the top flap does not cover the open end and the package is transitionable between the stowed configuration and the unstowed configuration.

4. The package of claim 3, wherein the tab defines an opening, wherein in the closed configuration, the tab extends through a slot in the top flap of the outer box so that a retail hook may extend through the opening so that the package hangs from the retail hook.

5. The package of claim 1, wherein the transitioning from the stowed configuration to the unstowed configuration causes a radius of curvature of the front side to decrease so that the front side is bowed with a concave surface facing the top side.

6. The package of claim 1, wherein the peripheral tray further comprises a front top side coupled to the front side, a first flap portion coupled to front top side, and a second flap portion coupled to the first flap portion, wherein at least one of the first flap portion and the second flap portion are coupled to a third flap portion of the outer box.

7. The package of claim 6, wherein at least one of the first flap portion and the second flap portion are removably coupled to the third flap portion of the outer box.

8. The package of claim 7, wherein in the stowed configuration and the unstowed configuration the second flap portion is folded to overlap the first flap portion to define a channel, and wherein the third flap portion is positioned within the channel in order to be removably coupled to first flap portion and the second flap portion.

9. A method for unloading a computer peripheral device in a package, the method comprising:

receiving the package in a stowed configuration, the package comprising an outer box defining a first interior cavity and an open end and a peripheral tray comprising a rear side, a bottom side coupled to a bottom edge of the rear side, a front side coupled to the bottom side, a left side coupled to a left longitudinal edge of the rear side, a right side coupled to a right longitudinal edge of the rear side, and a top side coupled to a top edge of the rear side;

receiving an interaction with the peripheral tray; and transitioning the package from the stowed configuration wherein the rear side is positioned entirely within the first interior cavity of the outer box to an unstowed configuration wherein the rear side is at least partially positioned outside of the first interior cavity of the outer box, wherein in the stowed configuration the front side is positioned opposite the rear side, the left side is positioned opposite the right side, and the bottom side is positioned opposite the top side in order to define a second interior cavity configured to retain the computer peripheral device with the first interior cavity, and wherein transitioning from the stowed configuration to the unstowed configuration causes the bottom side to rotate from a stowed orientation substantially perpendicular to the rear side to an unstowed orientation substantially coplanar with the rear side, and causes a top portion of the rear side to be positioned outside of the first interior cavity so that the computer peripheral device is removable from the first interior cavity.

10. The method of claim 9, wherein the peripheral tray further comprises a tab coupled to the top side, and the method further comprises receiving the interaction as a pull at the tab by a user in order to transition the package from the stowed configuration to the unstowed configuration.

11. The method of claim 10, wherein the outer box comprises a top flap configured to transition between a closed configuration wherein the top flap retains the peripheral tray within the first interior cavity and the package is in the stowed configuration, and an open configuration wherein the top flap does not cover the open end and the package is transitionable between the stowed configuration and the unstowed configuration.

12. The method of claim 11, wherein the tab defines an opening, wherein in the closed configuration, the tab extends through a slot in the top flap of the outer box so that a retail hook may extend through the opening so that the package hangs from the retail hook.

13. The method of claim 9, wherein the transitioning from the stowed configuration to the unstowed configuration causes a radius of curvature of the front side to decrease so that the front side is bowed with a concave surface facing the top side.

14. The method of claim 9, wherein the peripheral tray further comprises a front top side coupled to the front side, a first flap portion coupled to front top side, and a second flap portion coupled to the first flap portion, wherein at least one of the first flap portion and the second flap portion are coupled to a third flap portion of the outer box.

15. The method of claim 14, wherein at least one of the first flap portion and the second flap portion are removably coupled to the third flap portion of the outer box.

16. The method of claim 15, wherein in the stowed configuration and the unstowed configuration the second flap portion is folded to overlap the first flap portion to define a channel, and wherein the third flap portion is positioned within the channel in order to be removably coupled to first flap portion and the second flap portion.

17. A package for a computer peripheral device, the package comprising:

an outer shell defining a first interior cavity and an open end; and a peripheral tray comprising a rear side, a bottom side coupled to a bottom edge of the rear side, and a tongue, wherein a first end of the tongue is coupled to the bottom side, wherein the peripheral tray is positioned within the first interior cavity of the outer shell with a second end of the tongue coupled to the outer shell and so that an elongated portion of the tongue between the first end and the second end contacts the outer shell and is deflected toward the rear side of the peripheral tray, and wherein the peripheral tray is configured to be slidably translated out of the first interior cavity through the open end so that a portion of the elongated portion of the tongue moves away from the rear side of the peripheral tray and the bottom side of the peripheral tray rotates within the first interior cavity.

18. The package of claim 17, wherein the peripheral tray further comprises:

a top side coupled to a top edge of the rear side; and a tab coupled to the top side, wherein the tab is configured to be pulled by a user in order to transition the package from a stowed configuration to an unstowed configuration.

19. The package of claim 18, wherein the outer shell comprises a top flap configured to transition between a closed configuration wherein the top flap retains the peripheral tray within the first interior cavity and the package is in the stowed configuration, and an open configuration wherein the top flap does not cover the open end and the package is transitionable between the stowed configuration and the unstowed configuration.

20. The package of claim 18, wherein transitioning from the stowed configuration to the unstowed configuration causes a radius of curvature of the tongue to decrease so that the tongue is bowed with a concave surface facing the top side.

* * * * *